US006978732B1

(12) United States Patent
Jirak

(10) Patent No.: US 6,978,732 B1
(45) Date of Patent: Dec. 27, 2005

(54) PONTOON TARPAULIN SYSTEM

(76) Inventor: Jerry D. Jirak, 1519 Beede Ave., Breckenridge, MN (US) 56520

( * ) Notice: Subject to any disclaimer, the term of this patent is extended or adjusted under 35 U.S.C. 154(b) by 0 days.

(21) Appl. No.: 10/949,639

(22) Filed: Sep. 24, 2004

(51) Int. Cl.[7] ..... B63B 17/00
(52) U.S. Cl. ..... 114/361; 114/364
(58) Field of Search ..... 114/343, 361, 364; 296/98

(56) References Cited

U.S. PATENT DOCUMENTS

| | | | | |
|---|---|---|---|---|
| 3,106,931 | A * | 10/1963 | Cooper | 114/361 |
| 4,302,043 | A | 11/1981 | Dimmer et al. | 296/98 |
| RE31,746 | E | 11/1984 | Dimmer et al. | 296/98 |
| 4,562,786 | A * | 1/1986 | Pruonto | 114/361 |
| 4,641,600 | A | 2/1987 | Halvorsen | 114/361 |
| 5,147,235 | A | 9/1992 | Bamburak et al. | 441/79 |
| 5,343,824 | A | 9/1994 | Floyd | 114/361 |
| 5,380,058 | A | 1/1995 | Short et al. | 296/98 |
| 5,479,872 | A | 1/1996 | Hulett | 114/361 |
| 5,481,999 | A | 1/1996 | Clark | 114/361 |
| 5,483,915 | A | 1/1996 | Clark | 114/361 |
| 5,809,929 | A | 9/1998 | Garnes | 114/361 |
| 5,823,067 | A | 10/1998 | Clarys et al. | 74/546 |
| 5,944,039 | A * | 8/1999 | Bergeron | 114/361 |
| 6,220,646 | B1 | 4/2001 | Merino Lamela | 296/98 |
| 6,260,505 | B1 * | 7/2001 | Polidan | 114/361 |
| 6,439,150 | B1 * | 8/2002 | Murphy et al. | 114/361 |

* cited by examiner

*Primary Examiner*—Lars A. Olson

(57) ABSTRACT

A pontoon tarpaulin system for efficiently covering a pontoon. The pontoon tarpaulin system includes a plurality of support poles vertically extendable from a floor of a pontoon, a plurality of support bands extending between the ends of the pontoon and attachable to an upper end of the support poles, and a tarpaulin attached to a core capable of being rolled upon support bands. A handle is attachable within the core for allowing the user to roll the tarpaulin from an open position to a closed position. A plurality of rear supports are attachable to a rear of the pontoon for supporting the tarpaulin when rolled into a storage position. A plurality of front hooks are attachable to a front of the pontoon for catchably engaging the core when the tarpaulin is in the closed position.

13 Claims, 9 Drawing Sheets

PONTOON TARPAULIN SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to pontoon covers and more specifically it relates to a pontoon tarpaulin system for efficiently covering a pontoon.

2. Description of the Related Art

Pontoon covers have been in use for years for protecting pontoons from weather and debris. Conventional pontoon covers are typically comprised of a single size that must be manually positioned over the pontoon. It can be time consuming and labor intensive to position a conventional pontoon cover upon a pontoon. Conventional pontoon covers also typically require 2 or more individuals to secure the cover upon a pontoon.

While these devices may be suitable for the particular purpose to which they address, they are not as suitable for efficiently covering a pontoon. Conventional pontoon covers are difficult to attach and remove with respect to a pontoon.

In these respects, the pontoon tarpaulin system according to the present invention substantially departs from the conventional concepts and designs of the prior art, and in so doing provides an apparatus primarily developed for the purpose of efficiently covering a pontoon.

BRIEF SUMMARY OF THE INVENTION

In view of the foregoing disadvantages inherent in the known types of pontoon covers now present in the prior art, the present invention provides a new pontoon tarpaulin system construction wherein the same can be utilized for efficiently covering a pontoon.

The general purpose of the present invention, which will be described subsequently in greater detail, is to provide a new pontoon tarpaulin system that has many of the advantages of the pontoon covers mentioned heretofore and many novel features that result in a new pontoon tarpaulin system which is not anticipated, rendered obvious, suggested, or even implied by any of the prior art pontoon covers, either alone or in any combination thereof.

To attain this, the present invention generally comprises a plurality of support poles vertically extendable from a floor of a pontoon, a plurality of support bands extending between the ends of the pontoon and attachable to an upper end of the support poles, and a tarpaulin attached to a core capable of being rolled upon support bands. A handle may be attached to the core for allowing the user to roll the tarpaulin from an open position to a closed position (and vice versa). It can be appreciated that a handle is not required to open or close the core if the user manually manipulates the core. A plurality of rear supports are attachable to a rear of the pontoon for supporting the tarpaulin when rolled into a storage position. A plurality of front hooks are attachable to a front of the pontoon for catchably engaging the core when the tarpaulin is in the closed position.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a pontoon tarpaulin system that will overcome the shortcomings of the prior art devices.

A second object is to provide a pontoon tarpaulin system for efficiently covering a pontoon.

Another object is to provide a pontoon tarpaulin system that can be attached and removed by a single person.

An additional object is to provide a pontoon tarpaulin system that does not require a significant amount of labor to attach and remove.

A further object is to provide a pontoon tarpaulin system that can be easily attached in windy conditions.

Another object is to provide a pontoon tarpaulin system that provides compact storage of a pontoon cover.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
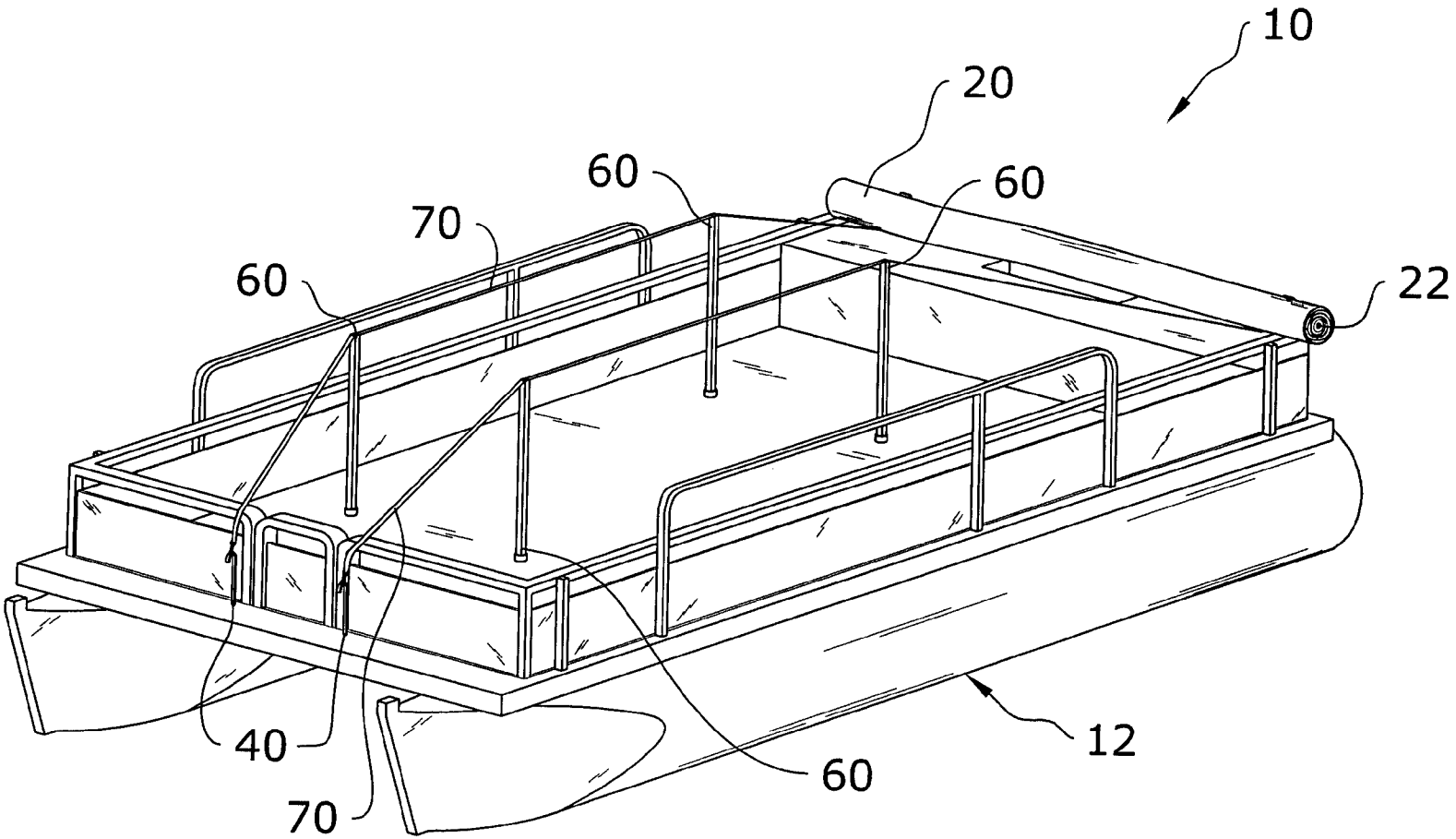
FIG. 1 is an upper perspective view of the present invention attached to a conventional pontoon in an open position.

Turning now descriptively to the drawings, in which similar reference characters denote similar elements throughout the several views, FIGS. 1 through 9 illustrate a pontoon tarpaulin system 10, which comprises a plurality of support poles 60 vertically extendable from a floor of a pontoon 12, a plurality of support bands 70 extending between the ends of the pontoon 12 and slidably attached to an upper end of the support poles 60, and a tarpaulin 20 attached to a core 22 capable of being rolled upon support bands 70. A handle 30 may be attached to the core 22 for allowing the user to roll the tarpaulin 20 from an open position to a closed position (and vice versa). It can be appreciated that a handle 30 is not required to open or close the core 22 if the user manually manipulates the core 22. A plurality of rear supports 50 are attachable to a rear of the pontoon 12 for supporting the tarpaulin 20 when rolled into a storage position. A plurality of front hooks 40 are attachable to a front of the pontoon 12 for catchably engaging the core 22 when the tarpaulin 20 is in the closed position.

B. Support Poles

Figure 3:
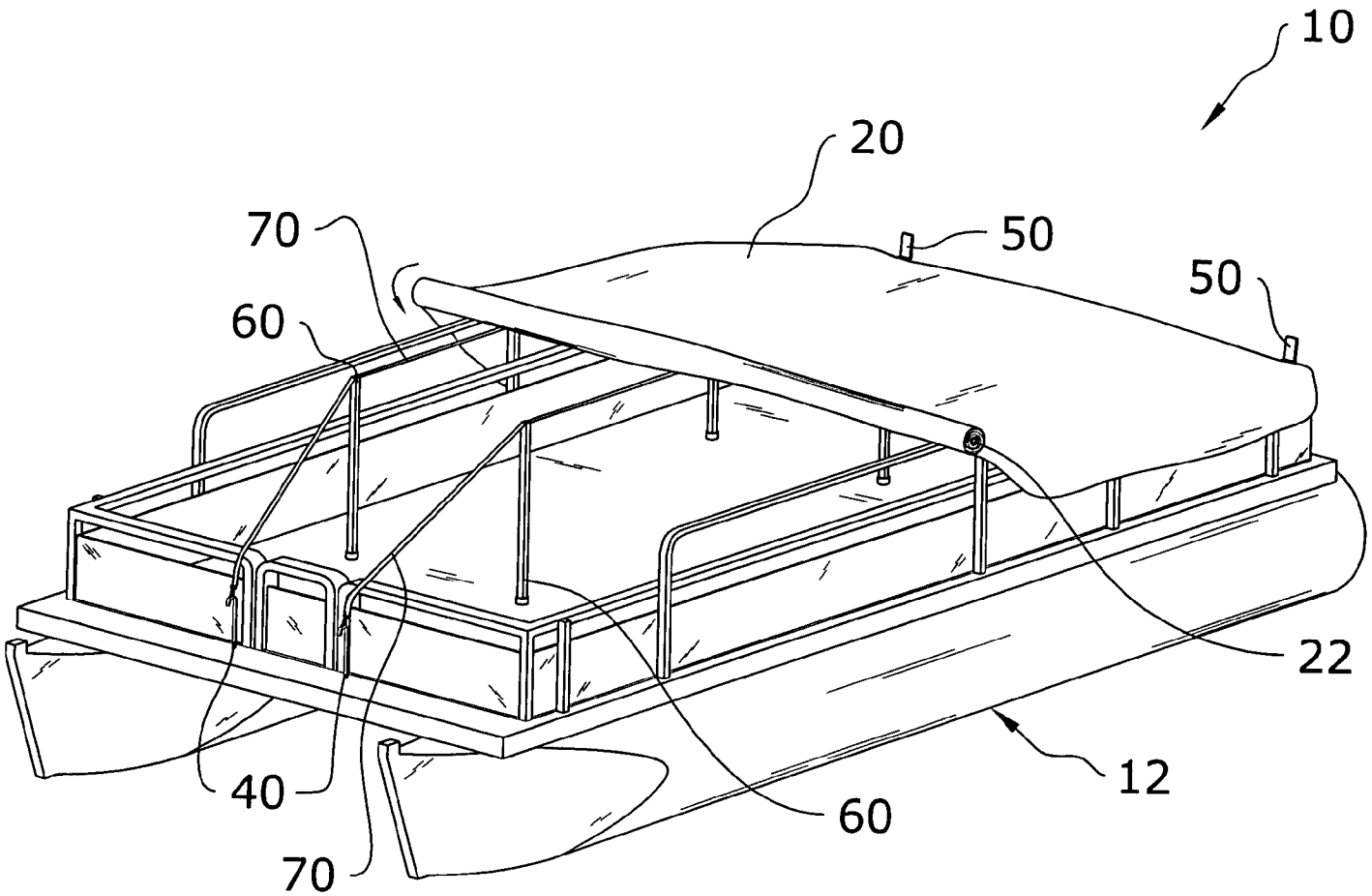
FIG. 3 is an upper perspective view of the present invention partially closed upon the conventional pontoon.

A plurality of support poles 60 vertically extend from a floor of a pontoon 12 as shown in FIGS. 1 and 3 of the drawings. The length of the support poles 60 may vary depending upon the size and height of the pontoon 12 to be attached to. It is desirable to have the length of the support poles 60 sufficient to extend above the highest portions of the pontoon 12 to support the tarpaulin 20 above the pontoon 12. The support poles 60 are preferably not attached to the floor of the pontoon 12 to allow for easy removal and adjustment of the same, however it can be appreciated that various mounting devices may be attached between the support poles 60 and the floor of the pontoon 12.

Figure 2:
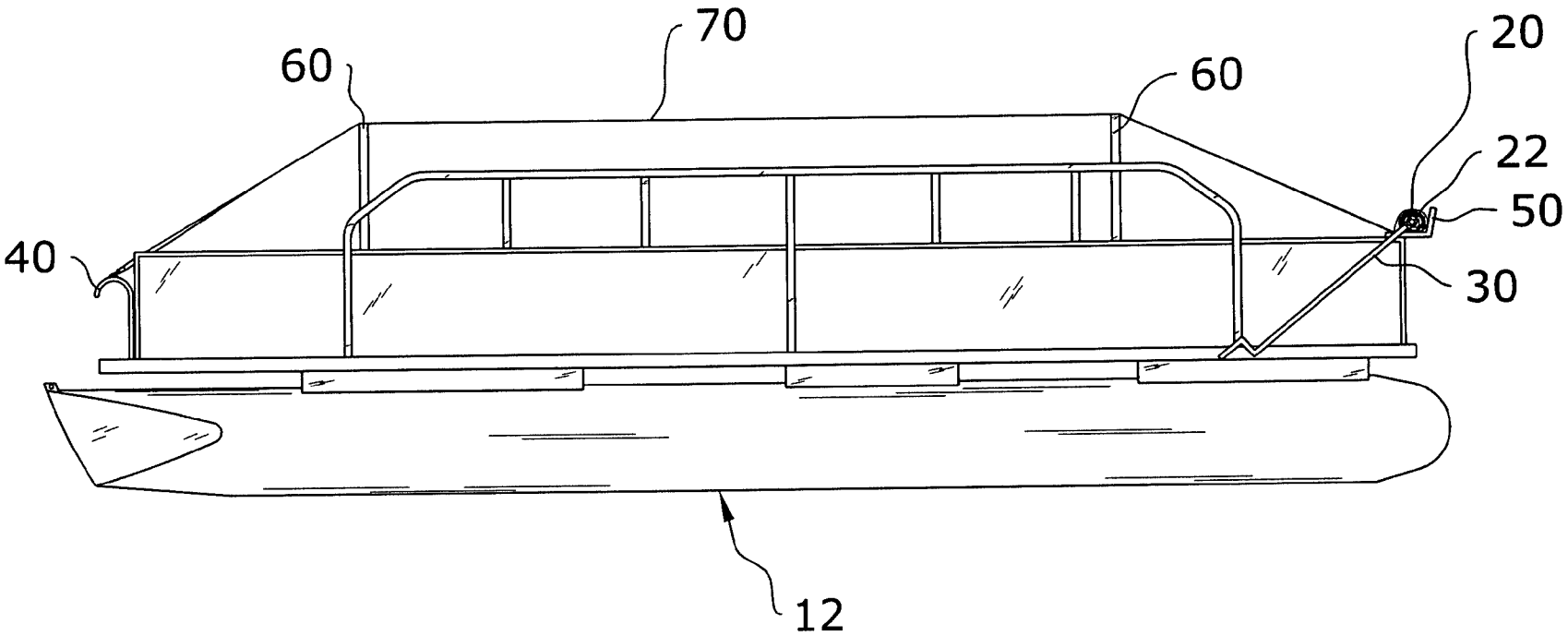
FIG. 2 is a side view of the present invention in an open position upon a conventional pontoon.
Figure 8:
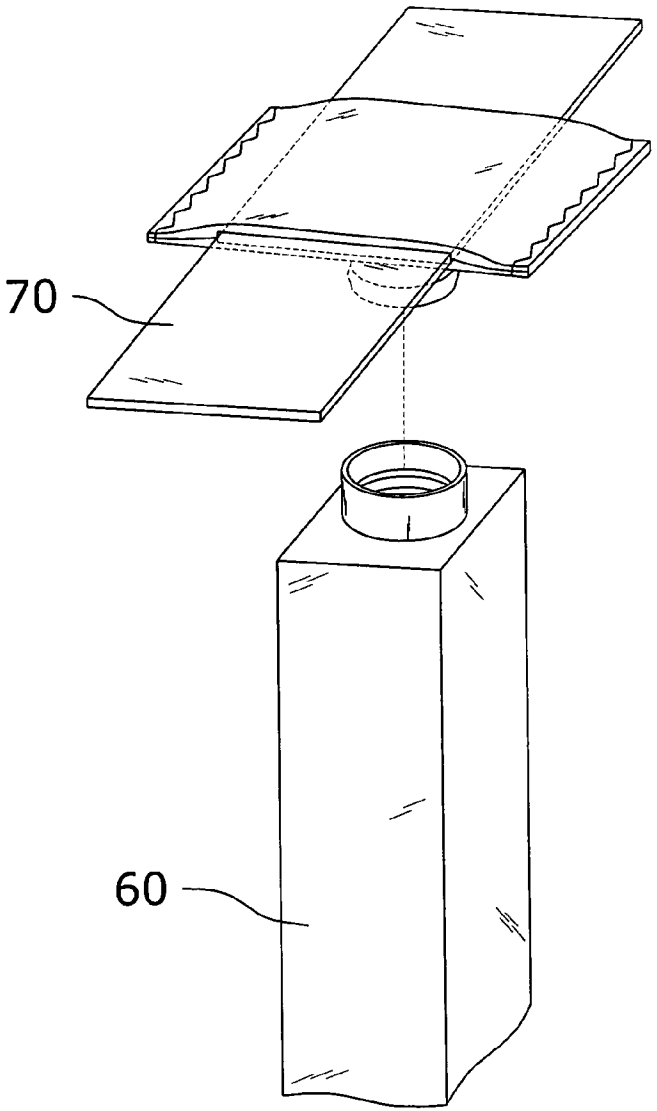
FIG. 8 is an exploded upper perspective view of the attachable means of the support pole to the support band.
Figure 9:
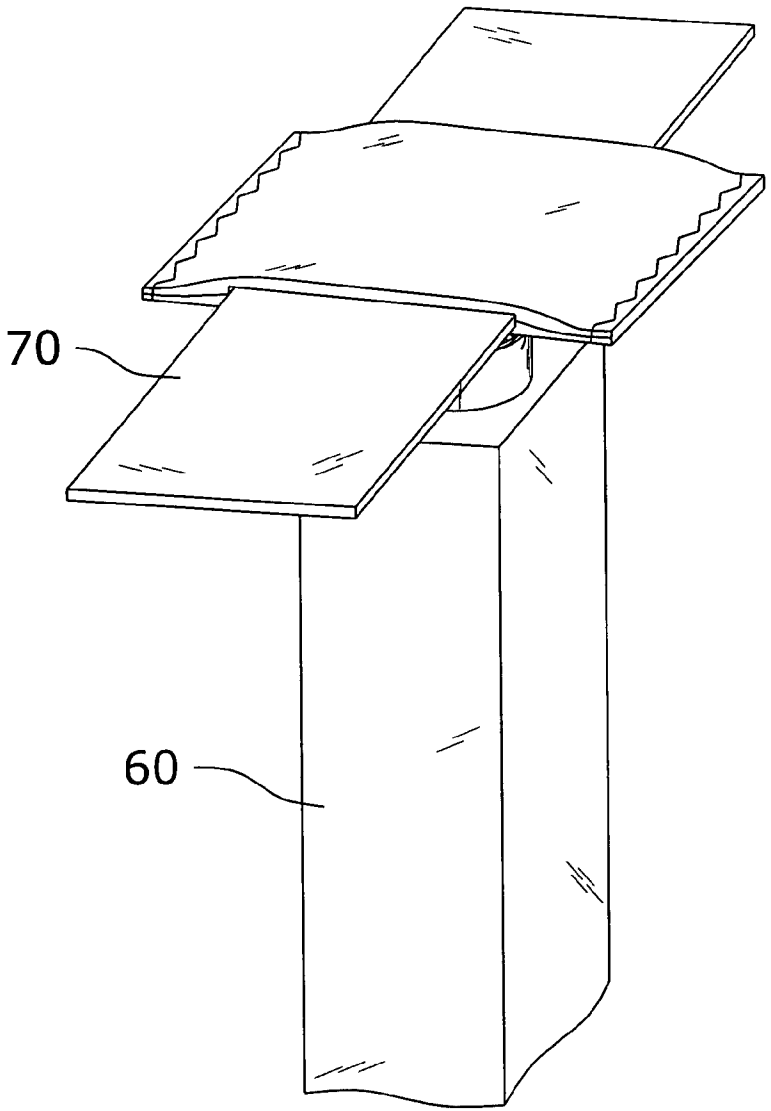
FIG. 9 is an upper perspective view of the support pole slidably attached to the support band.

As shown in FIGS. 1, 8 and 9 of the drawings, at least two support poles 60 are preferably attachable to each of the support bands 70 to provide adequate support to the support bands 70. The support poles 60 provide a front angled portion and a rear angled portion for the support bands 70 as shown in FIG. 2 of the drawings.

C. Support Bands

At least one support band 70 is attached between opposing ends of a pontoon 12 (or to the front hooks 40 and the rear supports 50). FIGS. 1 and 3 illustrate that it is preferable to utilize at least two support bands 70 to provide stable support of the tarpaulin 20, though greater or less may be used.

At least one support band 70 is attachable to an upper end of the support poles 60 as shown in FIGS. 1 through 3, 8 and 9 of the drawings. The support bands 70 are extendable substantially parallel to a longitudinal axis of a pontoon 12 as best illustrated in FIG. 1 of the drawings. The support bands 70 are preferably comprised of an elongated flexible material that may be drawn in a taut manner between the opposing ends of the pontoon 12.

D. Core

Figure 5:
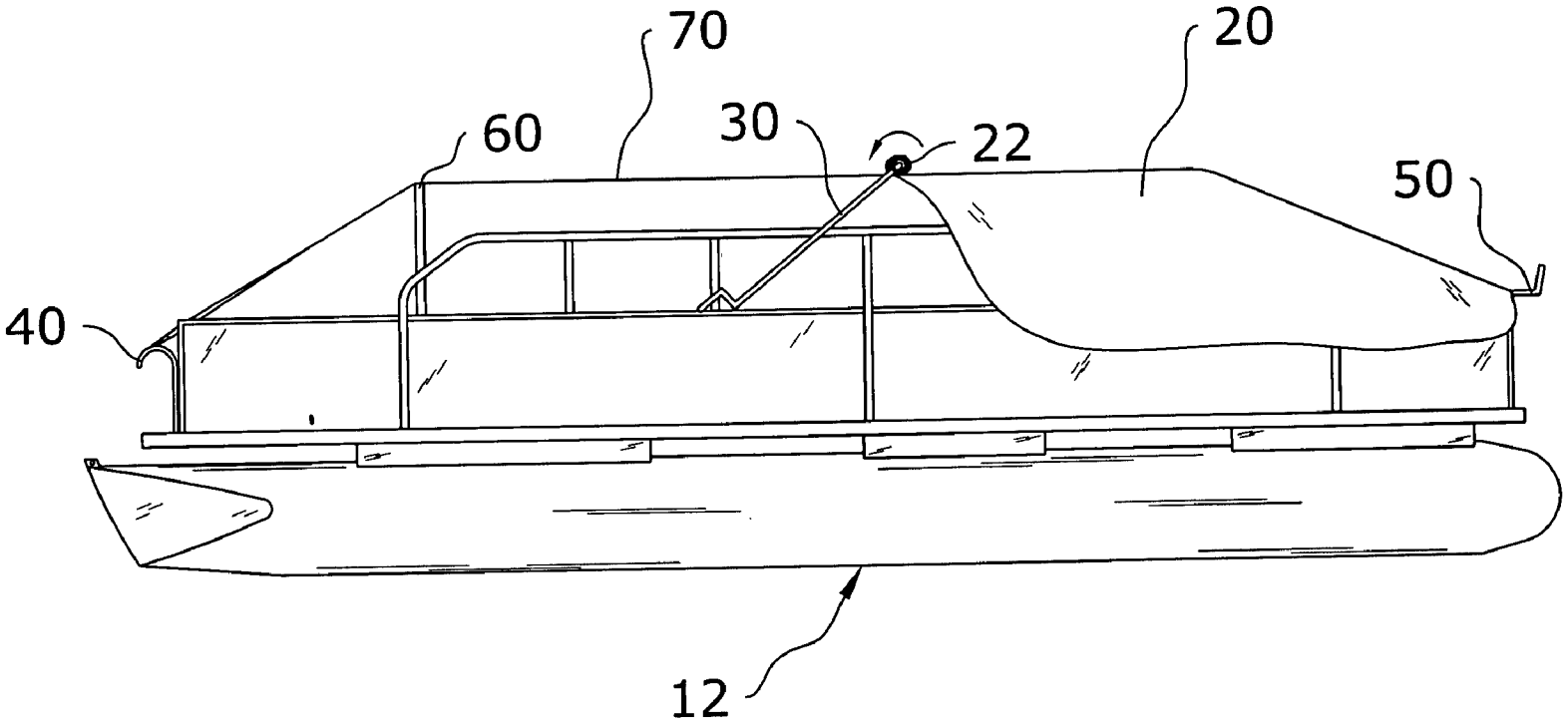
FIG. 5 is a side view of the present invention partially closed upon the conventional pontoon.
Figure 6:
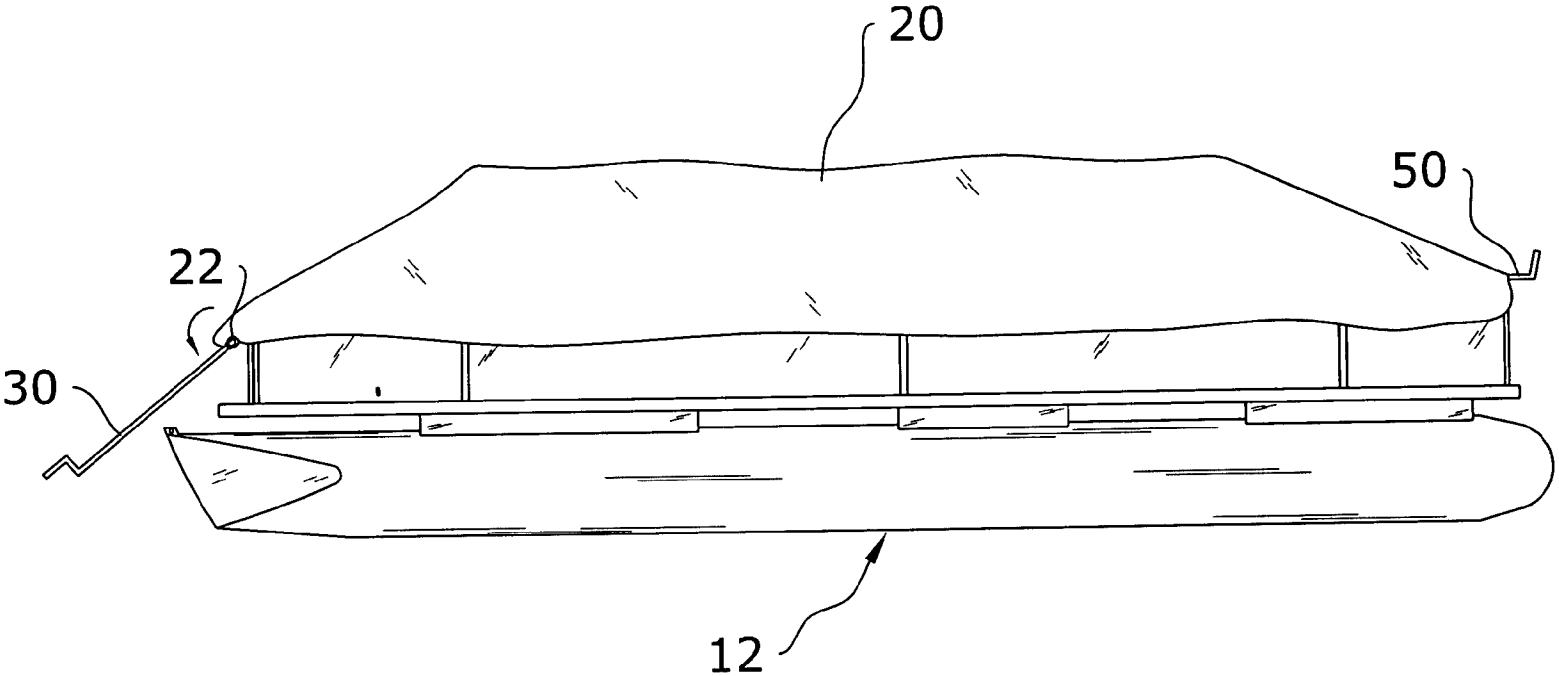
FIG. 6 is a side view of the present invention almost fully closed upon the conventional pontoon.
Figure 7:
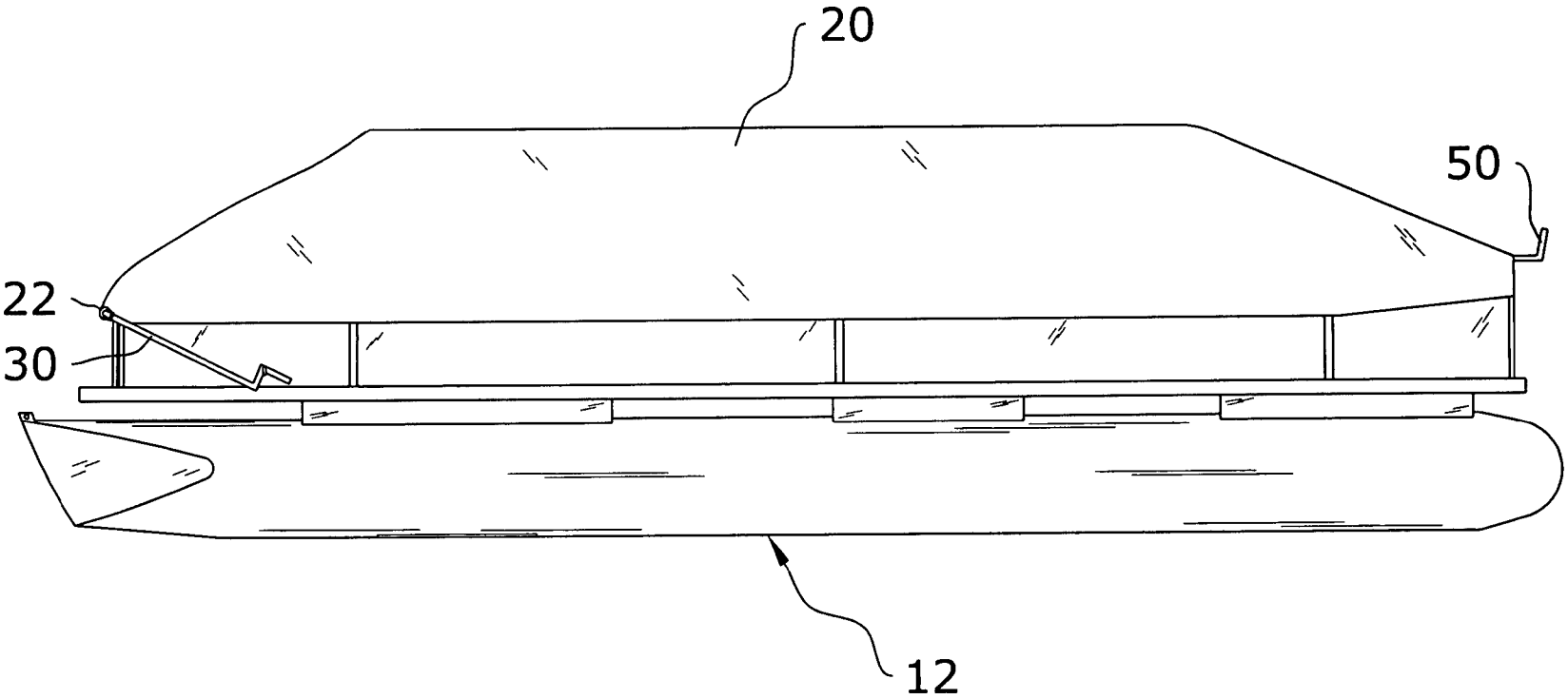
FIG. 7 is a side view of the present invention fully closed upon a conventional pontoon.

The core 22 has an elongated structure and is positionable upon the at least one support band 70. The core 22 has a width sufficient to receive at least a significant width of the tarpaulin 20. The core 22 is capable of being rolled upon the support bands 70 to extend the tarpaulin 20 in a closed position (FIG. 4) or retract the tarpaulin 20 to a compact open position (FIG. 1). A handle 30 is preferably removably attachable to the core 22 for allowing a user to rotate the core 22 and the tarpaulin 20 as shown in FIGS. 5 through 7 of the drawings.

E. Tarpaulin

Figure 4:
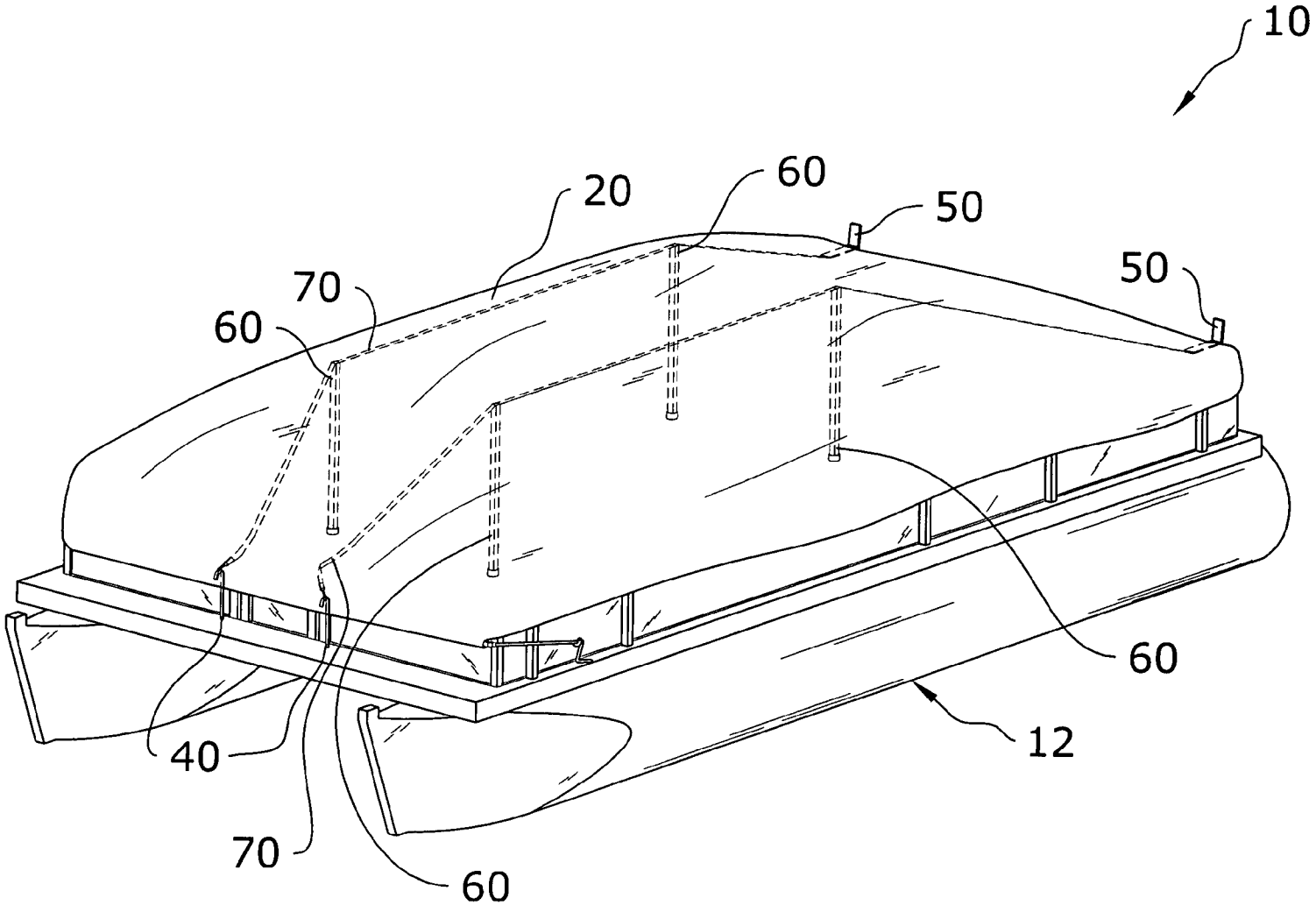
FIG. 4 is an upper perspective view of the present invention fully closed upon the conventional pontoon.

The tarpaulin 20 is comprised of a broad structure capable of covering the pontoon 12 while being supported by the support bands 70 as shown in FIG. 4 of the drawings. The tarpaulin 20 may be comprised of various materials and is preferably impermeable. The tarpaulin 20 is preferably formed to have a consistent lower side edge while being supported by the support band 70 as shown in FIG. 4 of the drawings.

An end of the tarpaulin 20 is preferably attached to the core 22 and the tarpaulin 20 is wound about the core 22 as shown in FIGS. 1 and 2 of the drawings. The tarpaulin 20 is positionable within a closed position (FIG. 4) and an open position (FIG. 1) with respect to the pontoon 12.

F. Rear Supports

A plurality of rear supports 50 are preferably attached to a rear end of the pontoon 12 for supporting the tarpaulin 20 when rolled into the storage position as shown in FIGS. 2 through 7 of the drawings. The rear supports 50 are preferably comprised of a hook structure (e.g. L-shape) that is capable of receiving the core 22 when the tarpaulin 20 is wound into the open position.

G. Front Hooks

A plurality of front hooks 40 are preferably attached to a front end of the pontoon 12 for catchably engaging the core 22 when the tarpaulin 20 is in the closed position. The front hooks 40 preferably have a hooked structure for receiving the core 22 when in the closed position as shown in FIG. 5 of the drawings.

H. Operation of Invention

In use, the user attaches the support bands 70 to a front end and a rear end of the pontoon 12 as further shown in FIGS. 1 and 2 of the drawings. The user then positions the support poles 60 with their corresponding support bands 70 upon a floor of a pontoon 12 in a vertical manner as shown in FIGS. 1, 2, 8 and 9 of the drawings. The core 22 surrounded by the tarpaulin 20 is positioned upon the rear supports 50 with a first end of the tarpaulin 20 attached to the rear end of the pontoon 12 and a second end of the tarpaulin 20 attached to the core 22. The user then may attach a handle 30 to the core 22 and then rotates the core 22 in a first direction to cause the tarpaulin 20 to cover the support bands 70 and the pontoon 12 as shown in FIGS. 3, 5 and 6 of the drawings. It can be appreciated that a handle 30 is not required to open or close the core 22 if the user manually manipulates the core 22. The support bands 70 support the core 22 and the tarpaulin 20 above the upper structures of the pontoon 12 as shown in FIGS. 3 through 7 of the drawings. When the core 22 passes beneath the front hooks 40 as shown in FIG. 6 of the drawings, the user continues to rotate the core 22 in the first direction which causes a front portion of the tarpaulin 20 and the core 22 to extend upwardly engaging a plurality of front hooks 40 attached to the front end of the pontoon 12. The user continues rotating the core 22 in the first direction until the tarpaulin 20 is sufficiently taut upon the support bands 70. The core 22 is then retained catchably within the front hooks 40 to maintain the tarpaulin 20 in a taut state. When the user desires to operate the pontoon 12, the above procedure is simply reversed.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A pontoon tarpaulin, comprising:

a plurality of support poles vertically extendable from a floor of a pontoon;

at least one support band extendable between opposing ends of a pontoon, wherein said at least one support band is attachable to an upper end of said support poles;

wherein said at least one support band is comprised of a pair of support bands;

wherein said plurality of support poles are comprised of a first set of support poles attachable to one of said pair of support bands and a second set of support poles attachable to another of said pair of support bands;

a core having an elongated structure positionable upon said at least one support band and capable of being rolled upon said at least one support band; and a tarpaulin, wherein an end of said tarpaulin is attached to said core and wherein said tarpaulin is positionable within a closed position and an open position with respect to a pontoon.

2. The pontoon tarpaulin of claim 1, wherein said at least one support band is extendable substantially parallel to a longitudinal axis of a pontoon.

3. The pontoon tarpaulin of claim 1, wherein said at least one support band is comprised of a flexible material.

4. The pontoon tarpaulin of claim 1, wherein said pair of support bands are substantially parallel to one another.

5. The pontoon tarpaulin of claim 4, wherein said pair of support bands are aligned along a common horizontal plane.

6. The pontoon tarpaulin of claim 1, including a handle attachable to said core for allowing a user to rotate said core and said tarpaulin.

7. A pontoon tarpaulin system, comprising:

a plurality of support poles vertically extendable from a floor of a pontoon;

at least one support band attached between opposing ends of a pontoon, wherein said at least one support band is attachable to an upper end of said support poles;

a core having an elongated structure positionable upon said at least one support band and capable of being rolled upon said at least one support band;

a tarpaulin, wherein an end of said tarpaulin is attached to said core and wherein said tarpaulin is positionable within a closed position and an open position with respect to said pontoon;

a plurality of rear supports attached to a rear end of said pontoon for supporting said tarpaulin when rolled into said storage position; and a plurality of front hooks are attached to a front end of said pontoon for catchably engaging said core when said tarpaulin is in said closed position.

8. The pontoon tarpaulin system of claim 7, wherein said at least one support band is extendable substantially parallel to a longitudinal axis of a pontoon.

9. The pontoon tarpaulin system of claim 7, wherein said at least one support band is comprised of a flexible material.

10. The pontoon tarpaulin system of claim 7, wherein said at least one support band is comprised of a pair of support bands.

11. The pontoon tarpaulin system of claim 10, wherein said plurality of support poles are comprised of a first set of support poles attachable to one of said pair of support bands and a second set of support poles attachable to another of said pair of support bands.

12. The pontoon tarpaulin system of claim 7, including a handle attachable to said core for allowing a user to rotate said core and said tarpaulin.

13. A method of covering a pontoon with a tarpaulin, said method comprising the steps of:

attaching at least one support band to a front end and a rear end of a pontoon;

positioning a plurality of support poles supporting said at least one support band upon a floor of said pontoon in a vertical manner;

providing a core surrounded by a tarpaulin;

positioning said core and said tarpaulin upon said at least one support band; and rotating said core in a first direction to cause said tarpaulin to cover said at least one support band and said pontoon; and rotating said core such that said rotation causes a front portion of said tarpaulin and said core to extend upwardly engaging a plurality of front hooks attached to said front end of said pontoon.

* * * * *